US010919045B2

(12) United States Patent
Weh et al.

(10) Patent No.: US 10,919,045 B2
(45) Date of Patent: Feb. 16, 2021

(54) METHOD AND DEVICE FOR FRAGMENTING AND/OR WEAKENING POURABLE MATERIAL BY MEANS OF HIGH-VOLTAGE DISCHARGES

(71) Applicant: selFrag AG, Kerzers (CH)

(72) Inventors: Alexander Weh, Engen (DE); Jean-Pierre Aeby, Belfaux (CH); Johannes Käppeler, Laupen (CH)

(73) Assignee: selFrag AG, Kerzers (CH)

( * ) Notice: Subject to any disclaimer, the term of this patent is extended or adjusted under 35 U.S.C. 154(b) by 565 days.

(21) Appl. No.: 15/553,928

(22) PCT Filed: Feb. 24, 2016

(86) PCT No.: PCT/CH2016/000033
§ 371 (c)(1),
(2) Date: Aug. 25, 2017

(87) PCT Pub. No.: WO2016/134492
PCT Pub. Date: Sep. 1, 2016

(65) Prior Publication Data

US 2018/0353968 A1 Dec. 13, 2018

(30) Foreign Application Priority Data

Feb. 27, 2015 (WO) ..... PCT/CH2015/000030
Feb. 27, 2015 (WO) ..... PCT/CH2015/000031
Feb. 27, 2015 (WO) ..... PCT/CH2015/000032

(51) Int. Cl.
*B02C 19/18* (2006.01)
*B02C 23/02* (2006.01)
(Continued)

(52) U.S. Cl.
CPC ..... *B02C 19/18* (2013.01); *B02C 23/02* (2013.01); *B02C 23/10* (2013.01); *B02C 23/36* (2013.01); *B02C 2019/183* (2013.01)

(58) Field of Classification Search
CPC ..... B02C 19/18; B02C 19/183; B02C 23/36; B02C 23/22; B02C 23/12; B02C 23/02; B01J 19/08
(Continued)

(56) References Cited

U.S. PATENT DOCUMENTS 3,208,674 A 9/1965 Bailey
3,604,641 A * 9/1971 Wilson ..... B02C 19/18 241/301
(Continued)

FOREIGN PATENT DOCUMENTS

BE 864969 A2 7/1978
DE 19545580 A1 6/1997
(Continued)

OTHER PUBLICATIONS

International Search Report for PCT/CH2015/000030, dated Dec. 14, 2015.
(Continued)

*Primary Examiner* — Faye Francis
(74) *Attorney, Agent, or Firm* — Marshall, Gerstein & Borun LLP

(57) ABSTRACT

According to a method for fragmenting of pourable material by high-voltage discharges, a material flow of the material, immersed in a process liquid, is guided past an electrode assembly by a conveying device carrying the material flow. By charging the electrode assembly with high-voltage pulses, high-voltage punctures through the material of the material flow are produced. The electrodes of the electrode assembly are immersed in the process liquid from above,
(Continued)

and those of these electrodes between which the high-voltage punctures are produced face each other with an electrode spacing transverse to the material flow direction.

36 Claims, 19 Drawing Sheets

(51) Int. Cl.
*B02C 23/10* (2006.01)
*B02C 23/36* (2006.01)

(58) Field of Classification Search
USPC ..... 241/1
See application file for complete search history.

(56) References Cited

U.S. PATENT DOCUMENTS

| | | | | |
|---|---|---|---|---|
| 4,182,216 | A | 1/1980 | DeCaro | |
| 4,540,127 | A * | 9/1985 | Andres | B02C 19/18 241/1 |
| 5,758,831 | A * | 6/1998 | Collins | B02C 19/186 241/1 |
| 5,842,650 | A | 12/1998 | Hofmann | |
| 6,039,274 | A * | 3/2000 | Zinoviev | B02C 19/18 241/1 |
| 7,246,761 | B2 * | 7/2007 | Hoppe | B02C 19/18 166/248 |
| 7,677,486 | B2 * | 3/2010 | Hoppe | B02C 19/18 241/301 |
| 10,399,085 | B2 * | 9/2019 | Muller | B09B 3/00 |
| 2005/0051644 | A1 * | 3/2005 | Paris | B02C 19/18 241/1 |
| 2005/0180841 | A1 | 8/2005 | Cao | |
| 2007/0187539 | A1 * | 8/2007 | Hoppe | B02C 19/18 241/301 |
| 2008/0283639 | A1 * | 11/2008 | Frey | B02C 19/18 241/20 |
| 2010/0025240 | A1 * | 2/2010 | Muller-Siebert | B02C 19/18 204/421 |
| 2012/0205472 | A1 * | 8/2012 | Bentaj | B02C 19/18 241/1 |
| 2014/0130335 | A1 | 5/2014 | Bickford et al. | |

FOREIGN PATENT DOCUMENTS

| | | | |
|---|---|---|---|
| DE | 19727534 | A1 | 1/1999 |
| DE | 197 36 027 | A1 | 3/1999 |
| DE | 19902010 | A1 | 8/2000 |
| DE | 69913493 | T2 | 5/2004 |
| FR | 982415 | A | 6/1951 |
| FR | 2302441 | A1 | 9/1976 |
| GB | 854830 | A | 11/1960 |
| JP | H09174552 | A | 7/1997 |
| JP | H09192526 | A | 7/1997 |
| JP | 2003154286 | A | 5/2003 |
| JP | 200475377 | A | 3/2004 |
| JP | 201283017 | A | 4/2012 |
| KR | 20120139638 | A | 12/2012 |
| RU | 2263545 | C1 | 11/2005 |
| RU | 113177 | U1 | 2/2012 |
| RU | 2667750 | C1 | 9/2018 |
| RU | 2670126 | C1 | 10/2018 |
| SU | 1178487 | A1 | 9/1985 |
| SU | 1538928 | A1 | 1/1990 |
| SU | 888355 | A1 | 11/1991 |
| WO | WO-1999003588 | A1 | 1/1999 |
| WO | WO-2013053066 | A1 | 4/2013 |

OTHER PUBLICATIONS

International Search Report for International Application No. PCT/CH2015/000031, dated Dec. 11, 2015.
International Search Report for PCT/CH2015/000032, dated Dec. 4, 2015.
International Search Report for PCT/CH2016/000033, dated Jun. 6, 2016.
International Search Report for PCT/CH2015/000181, dated Mar. 10, 2016.
Written Opinion for international application No. PCT/CH2015/000181, dated Dec. 10, 2015.
Decision to Grant related application RU 2 670 126, dated Aug. 24, 2018.
Decision to Grant related application RU 2667750, dated Aug. 15, 2018.
Office Action for application JP 2017-545395, dated Jan. 14, 2020.

* cited by examiner

METHOD AND DEVICE FOR FRAGMENTING AND/OR WEAKENING POURABLE MATERIAL BY MEANS OF HIGH-VOLTAGE DISCHARGES

CROSS-REFERENCE TO RELATED APPLICATIONS

This is the United States national phase of International Patent Application No. PCT/CH2015/000033, filed Feb. 24, 2016, which claims the benefit of priority of PCT/CH2015/00030, filed Feb. 27, 2015; PCT/CH2015/00031 filed Feb. 27, 2015; PCT/CH2015/00032 filed Feb. 27, 2015, the entire contents of which are hereby incorporated herein by reference.

TECHNICAL FIELD

The invention relates to a method for the fragmenting and/or weakening of pourable material by means of high-voltage discharges, a device for carrying out the method, an apparatus comprising a plurality of such devices as well as a use of the device or the apparatus according to the preambles of the independent patent claims.

BACKGROUND

From the state of the art, it is known to crush (fragment) the most diverse materials by means of pulsed high-voltage discharges or to weaken them in such a way that they can be crushed more easily in a subsequent mechanical comminution process.

For the fragmenting and/or weakening of pourable material by means of high-voltage discharges, two different process types are in principle known today.

In the case of small material quantities or strict requirements concerning the purity and/or the target grain size of the processed material, the fragmenting and/or weakening of the material takes place in a batch operation in a closed process vessel in which high-voltage punctures through the material are produced.

In the case of large material quantities, the fragmenting and/or weakening of the material is carried out in a continuous process by guiding a material flow of the to-be-crushed material past one or more electrodes and with these high-voltage punctures through the material are produced. Thereby, the material transport past the electrodes takes place either by means of gravitational force conveying or by means of a conveying device which at the same time serves as a counter-electrode to one or more high-voltage electrodes. In the former case, there is the problem that the material flow or the dwell time of the material in the process zone can only be set to a very limited extent and is strongly dependent on the piece size of the materials. In the latter case, the key disadvantage is that very complex conveying devices, which are at least electrically conductive in the region of the process zone, are required, which are expensive and are also subject to severe wear.

GENERAL DESCRIPTION

It is therefore an object to provide continuous methods and devices for fragmenting and/or weakening of large quantities of pourable material by means of high-voltage discharges which do not have the aforementioned disadvantages of the state of the art or at least in part avoid these.

According to these, a first aspect of the invention relates to a method for fragmenting and/or weakening of pourable material, in particular of slag from waste incineration, by means of high-voltage discharges.

Thereby, a material flow from the to-be-fragmented or weakened material, immersed in a process liquid, is guided past an electrode assembly with one or more high-voltage electrodes and to these high-voltage electrodes assigned counter-electrodes by means of a conveying device carrying the material flow, while high-voltage punctures between the high-voltage electrodes and the assigned counter-electrodes are produced through the material of the material flow by charging of the electrode assembly with high-voltage pulses by means of one or more high-voltage generators.

The high-voltage electrodes and counter-electrodes assigned to these are thereby immersed in the process liquid from above, and those of these electrodes between which the high-voltage punctures are produced face each other with an electrode spacing transversely to the material guiding past direction.

In this way, it becomes possible to provide a continuous process for the fragmenting and/or weakening of large quantities of pourable material, in which the dwell time of the material in the process zone can be adjusted over wide ranges and practically independently from the piece size of the materials and at the same time complex conveying devices, which are at least electrically conductive in the region of the process zone, which are expensive and are also subject to severe wear can be forgone.

In a preferred embodiment of the process, the high-voltage electrodes and the counter-electrodes between which the high-voltage punctures are produced are in contact with the material flow.

In a further preferred embodiment of the process, they are even immersed in the material flow.

Depending on the material and the piece size of the to-be-fragmented material and/or the type or quality of the process liquid, respectively, the one or the other embodiment may be more preferred.

According to a further advantageous embodiment of the method, the material flow is formed from material pieces which do not exceed a specific maximum piece size, and preferably have a maximum piece size in the range between 40 mm and 80 mm.

In this case, it is preferred that the electrode spacing is in each case larger than this maximum piece size. This results in the advantage that the material pieces can, with the electrodes being immersed in the material flow, pass between these, as a result of which a particularly intensive charging of the material pieces with the high-voltage punctures becomes possible. In addition, it is thereby possible in a relatively simple way to charge the material flow with high-voltage punctures essentially over its entire width, which is also preferred.

Furthermore, it is thereby preferred that the distance of the electrodes to the bottom side of the material flow, i.e., to the upper side of the conveying device carrying the material flow, is larger than this maximum piece size. This results in the advantage that the material pieces cannot be clamped between the upper side of the conveying device and the electrodes when the electrodes are in contact with the material flow or are immersed in the material flow, as a result of which the operational reliability and lifetime of the device are considerably improved.

In yet another preferred embodiment of the method, the material of the material flow or a part thereof is divided into coarse material with a piece size larger than a desired target size and into fine material with a piece size smaller than or equal to the desired target size downstream of the electrode assembly.

Thereby, it is further preferred that the coarse material is fed again into the material flow upstream of the electrode assembly in order to be again guided past the electrode assembly and to be fragmented or weakened, respectively, or that the coarse material is subjected to a further fragmenting or weakening process, in particular a further method according to this first aspect of the invention, in order to be further fragmented or weakened, respectively.

In yet another preferred embodiment of the method, a conveying device is used, which at least in the region in which it guides the material flow past the electrode assembly, is formed as viewed in the cross-section trough-shaped, in particular V-shaped. This results in the advantage that the pourable material can be guided from the lateral zones into the center and thereby a substantially complete charging of the material flow over its entire width with high-voltage punctures is simplified.

Advantageously, the material flow is guided past the electrode assembly by means of a flexible, electrically nonconductive conveyor belt, the boundary zones of which are arched upwards in the region in which it guides the material flow past the electrode assembly. Such conveyor belts are robust, low-maintenance and commercially available in various designs and sizes. The inclinations of the boundary zones of the conveyor belt are preferably adjusted to optimize the respective process. At its ends, the conveyor belt is preferably planar such that the smallest possible expansion of the boundary zones is required.

In this case, it is further preferred that the material flow is transported upwards with the conveyor belt downstream from the region in which it is guided with the conveyor belt past the electrode assembly and is fragmented or weakened there by means of high-voltage punctures, preferably in such a way that it is discharged out of the process liquid by the conveyor belt. In this way, complex additional devices for removing the processed material from the process liquid can be dispensed with.

This can be achieved in a particularly simple and cost-effective manner by using a straight conveyor belt which rises in the material guiding past direction of the material flow past the electrode assembly, in particular with an ascent angle of between 10 and 35 degrees.

In a further preferred embodiment of the method, the material flow transported upwards with the conveyor belt is fed from the delivery end of the conveyor belt, preferably via a device for sieving of material pieces fragmented to a specific target size, to a below arranged feeding end of another conveyor belt with which it is fed into a further fragmenting and/or weakening process, in particular according to this first aspect of the invention. Correspondingly, the described process is then part of a multi-stage fragmenting and/or weakening method.

In the method according to the invention, preferably, an electrode assembly is used, which comprises a plurality of electrode pairs or electrode groups, wherein to each electrode pair or each electrode group, respectively, is assigned an own high-voltage generator, with which exclusively this pair or group, respectively, is charged with high-voltage pulses, advantageously independently of the other electrode pairs or electrode groups. In this way, a particularly intensive charging of the material flow guided past the electrode assembly is possible.

Here, an electrode pair is understood as a combination of a high-voltage electrode, which is charged with high-voltage pulses by the high-voltage generator, and a single counter-electrode assigned to this high-voltage electrode, between which electrodes the high-voltage punctures take place.

An electrode group is understood here as a combination of a high-voltage electrode, which is charged with high-voltage pulses by the high-voltage generator, and a plurality of counter-electrodes assigned to this high-voltage electrode, between which electrodes the high-voltage punctures take place, wherein normally the actual high-voltage puncture takes place between the high-voltage electrode and that of the counter-electrodes between which the most favorable puncture conditions are currently present.

In yet another preferred embodiment of the method, the material flow is formed from material pieces or comprises material pieces which form a composite of metallic and non-metallic materials, which is e.g., the case with slag pieces from waste incineration. In the fragmenting or weakening, respectively, of such materials with the inventive method, the advantages of the invention are particularly apparent and it is a further advantage that the requirements for the quality of the process liquid, mostly water, are very low, as a result of which the costs for the process liquid treatment are extremely low.

Correspondingly, in such processes, it is advantageous to carry out the method with a process liquid having a conductivity of more than 500 μS/cm.

Thereby, the processed material emerging from the process is preferably divided into metallic material and non-metallic material, namely advantageously into ferromagnetic metals, non-ferromagnetic metals, and non-metallic material. In this way, a recycling or selective disposal, respectively, of the components of the processed material is simplified.

For producing the high-voltage punctures through the material flow, the electrode assembly is preferably charged with high-voltage pulses in the range between 100 kV and 300 kV, in particular in the range between 150 kV and 200 kV, wherein preferably the power per pulse is between 100 Joule and 1000 Joule, in particular between 300 Joule and 750 Joule. The high-voltage pulse frequencies are preferably in the range between 0.5 Hz and 40 Hz, in particular in the range between 5 Hz and 20 Hz, and the material flow is during the guiding past the electrode assembly preferably charged with 0.1 to 2.0, in particular 0.5 to 1.0 high-voltage punctures per millimeter of its extent in the guiding-past direction.

A second aspect of the invention relates to a device for carrying out the method according to the first aspect of the invention.

The device comprises an electrode assembly with one or more high-voltage electrodes and counter-electrodes assigned to these. Its high-voltage electrodes are chargeable with high-voltage pulses by one or more high-voltage generators.

Furthermore, the device comprises a conveying device, preferably in the form of a conveyor belt or a conveyor chain, which is at least partially arranged in a basin filled or fillable with a process liquid, in particular water, and with which in the intended operation a material flow of a pourable to-be-fragmented and/or weakened material, immersed in a process liquid, can be guided paste the electrode assembly, while high-voltage punctures through the material flow are produced by charging of the electrodes of the electrode assembly with high-voltage pulses.

In this case, the device is structured in such a way that, in the intended operation, the electrodes of the electrode assembly are immersed in the process liquid from above, and those of these electrodes between which the high-voltage punctures are produced face each other with an electrode spacing transversely to the material guiding past direction.

With the device according to the invention it is possible in a simple manner to carry out the method according to the first aspect of the invention with the advantages already presented.

In a preferred embodiment, the device is structured in such a way that in the intended operation, the high-voltage electrodes and the counter-electrodes between which the high-voltage punctures are produced are in contact with the material flow or are even immersed in this.

Depending on the material and the piece size of the to-be-fragmented material and/or on the type or quality, respectively, of the process liquid, the one or the other embodiment may be more preferred.

In a further preferred embodiment of the device, the distance between the electrodes between which high-voltage punctures are produced is larger than 40 mm each, more preferably larger than 80 mm each. This results in the advantage that correspondingly large pieces of material can, with electrodes being immersed in the material flow, pass between these, as a result of which a particularly intensive charging of the material pieces with the high-voltage punctures becomes possible. This also makes it possible to design the device in a simple manner in such a way that the material flow can be charged with high-voltage punctures essentially over its entire width, which is also preferred.

In yet another preferred embodiment, the device comprises, downstream of the electrode assembly, devices, in particular sieving devices, with which the processed material of the material flow or a part thereof can be divided into coarse material with a piece size larger than a desired target size and into fine material with a piece size smaller than or equal to the desired target size.

In yet another preferred embodiment of the device, the electrode assembly comprises several electrode pairs or electrode groups. In this case, a respective high-voltage generator is assigned to each electrode pair or electrode group, respectively, with which, in the intended operation, exclusively this electrode pair or this electrode group, respectively, can be charged with high-voltage pulses. In this way, a particularly intensive charging of the material flow guided past the electrode assembly becomes possible.

Here, an electrode pair is understood as a combination of a high-voltage electrode, which in the intended operation is charged with high-voltage pulses by the assigned high-voltage generator, and a single counter-electrode assigned to this high-voltage electrode, between which electrodes the high-voltage punctures take place in the intended operation.

An electrode group is understood here as a combination of a high-voltage electrode, which in the intended operation is charged with high-voltage pulses by the assigned high-voltage generator, and a plurality of counter-electrodes assigned to this high-voltage electrode, between which electrodes in the intended operation the high-voltage punctures take place, wherein normally the actual high-voltage puncture takes place between the high-voltage electrode and that of the counter-electrodes between which the most favorable puncture conditions are currently present.

In yet another preferred embodiment of the device, the conveying device, at least in the region in which it guides the material flow past the electrode assembly, is formed as viewed in the cross-section trough-shaped, preferably V-shaped. This results in the advantage that the pourable material can be guided from the lateral zones into the center and thereby a substantially complete charging of the material flow with high-voltage punctures over its entire width is simplified.

Advantageously, the conveying device thereby comprises a flexible, electrically nonconductive conveyor belt, with which the material flow is guided past the electrode assembly in the intended operation, the boundary zones of which are arched upwards in the region in which it guides the material flow past the electrode assembly. Such conveyor belts are robust, low-maintenance and commercially available in the widest variety of designs and sizes. The inclinations of the boundary zones of the conveyor belt are preferably adjustable for optimizing the respective process. At its ends, the conveyor belt is preferably planar such that the smallest possible expansion of the boundary zones results.

The conveying device of the device preferably comprises a conveyor belt which is structured in such a way that in the intended operation, the material flow is, downstream of the region in which it is guided past the electrode assembly with the conveyor belt and fragmented or weakened there by means of high-voltage punctures, transported upwards with the conveyor belt, preferably in such a way that it is discharged out of the process liquid by the conveyor belt. In this way, complex additional devices for removing the processed material from the process liquid can be dispensed with.

This can be achieved in a particularly simple and cost-effective manner by using a straight conveyor belt which rises in the material guiding past direction of the material flow, in particular with an ascent angle of between 10 and 35 degrees.

A third aspect of the invention relates to a multi-stage apparatus for fragmenting and/or weakening of pourable material, comprising several devices according to the second aspect of the invention connected in series in the material conveying direction.

The apparatus is designed in such a way that, in the intended operation, a material flow which is transported upwards with the conveyor belt of a first one of the devices, from the delivery end of this conveyor belt, preferably via a device for sieving of material pieces fragmented to a specific target size, is fed to the below arranged feeding end of a conveyor belt of a second device, following after the first device in the material conveying direction, with which it is guided past the electrode assembly of this second one of the devices and is further fragmented and/or weakened thereby.

With such multi-stage apparatuses, large amounts of material can be processed.

A fourth aspect of the invention relates to the use of the device according to the second aspect of the invention or the apparatus according to the third aspect of the invention for the fragmenting and/or weakening of material pieces which form a composite of non-metallic and metallic materials, preferably of slag pieces from waste incineration.

In such uses, the advantages of the invention are particularly apparent.

BRIEF DESCRIPTION OF THE DRAWINGS

Further embodiments, advantages and applications of the invention result from the dependent claims and from the now following description with reference to the figures. Thereby show:

Figure 14:
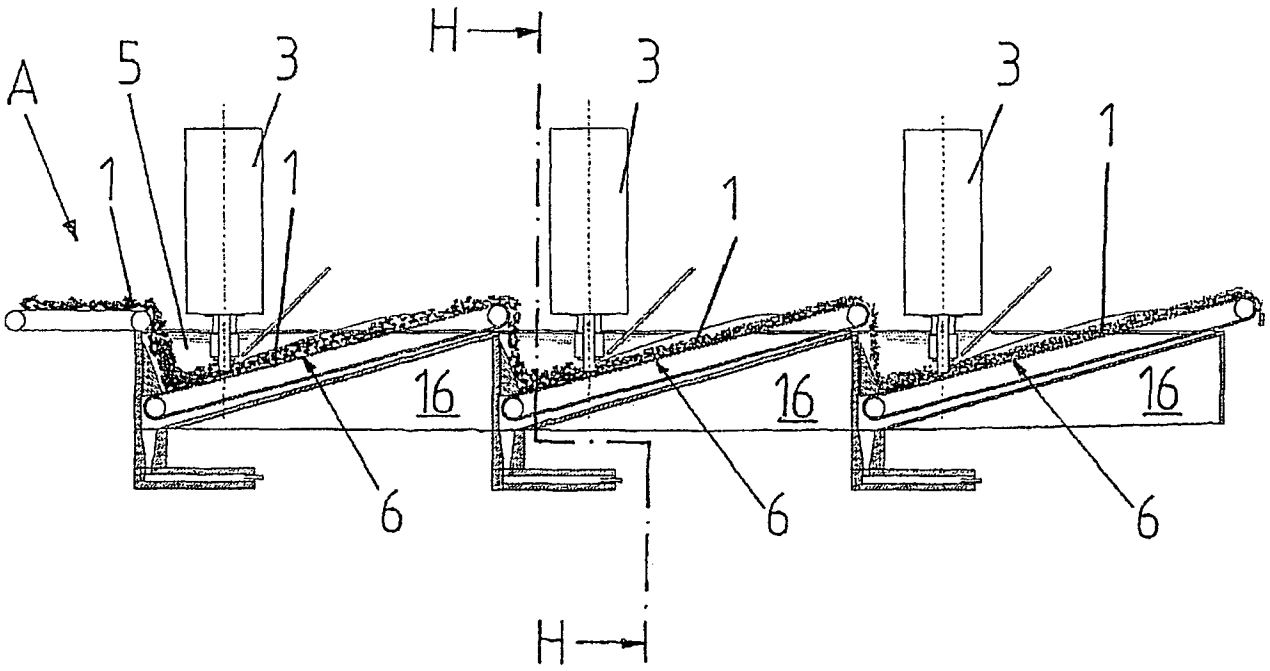
FIG. 14 a longitudinal section along the line G-G in FIG. 16*a* through an apparatus according to the invention.
Figure 15:
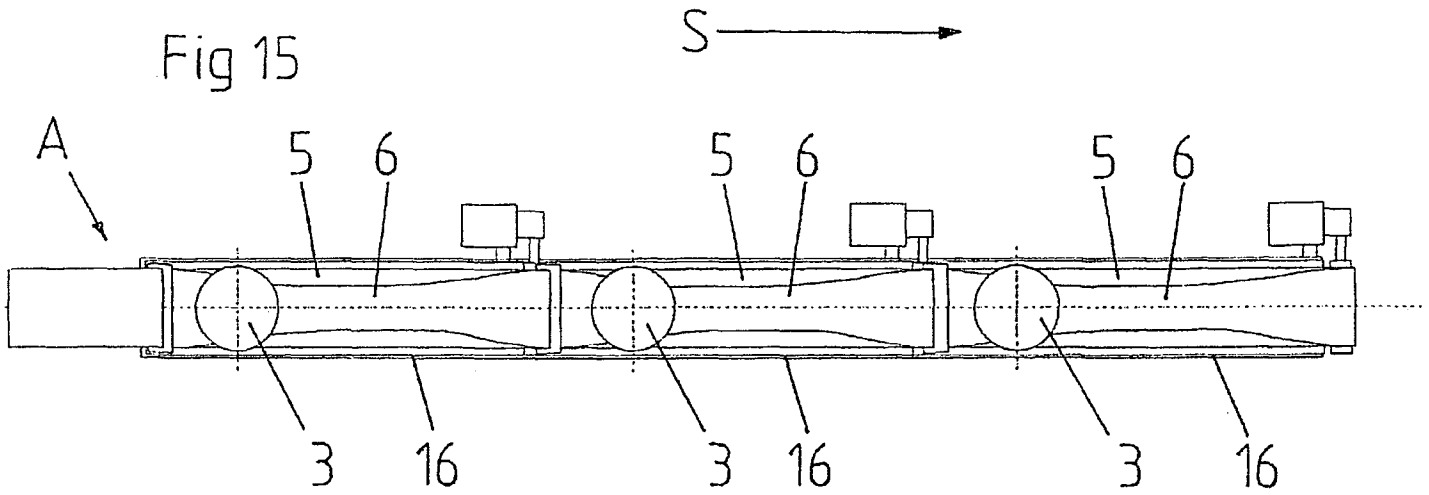
FIG. 15 a plan view from above on the apparatus from FIG. 14.
Figure 16A:
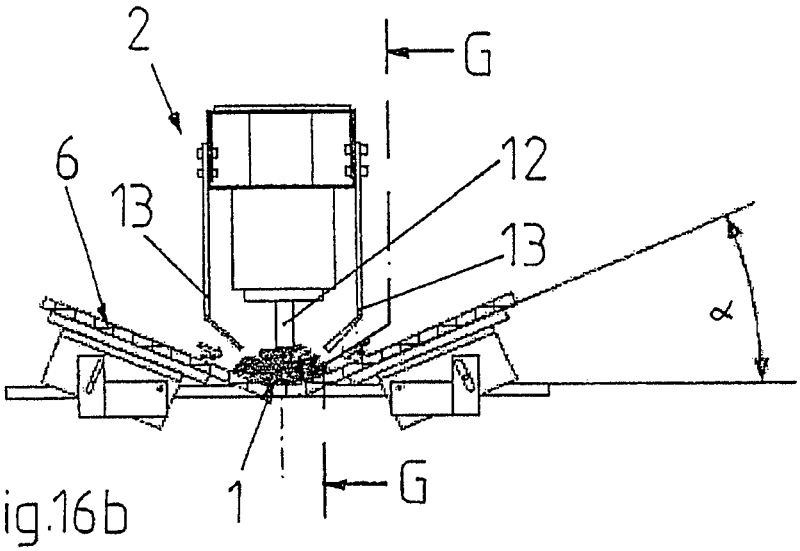
Figure 16B:
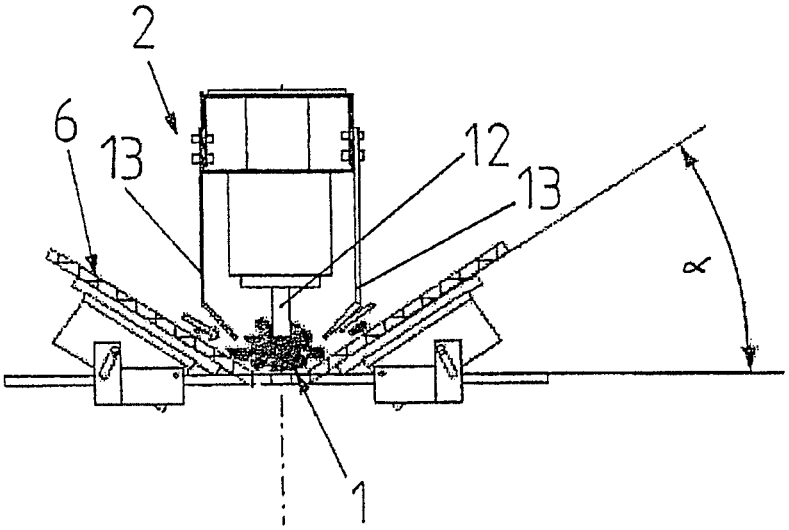
Figure 17:
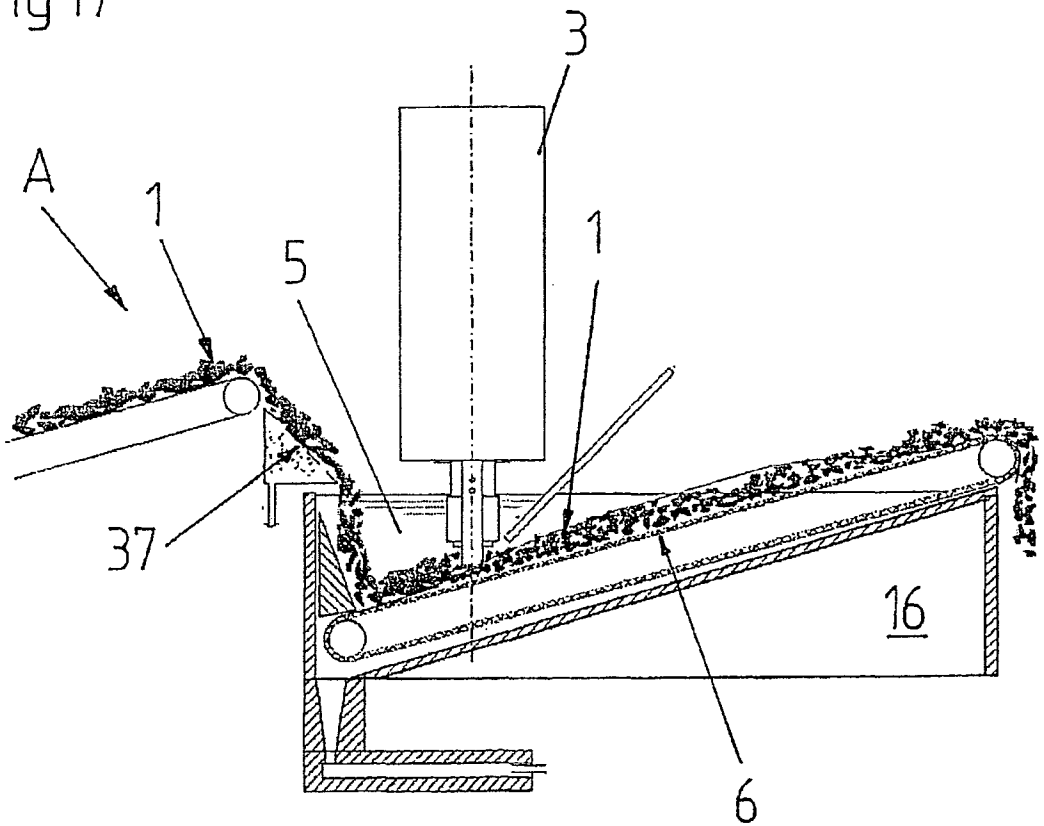
Figure 18:
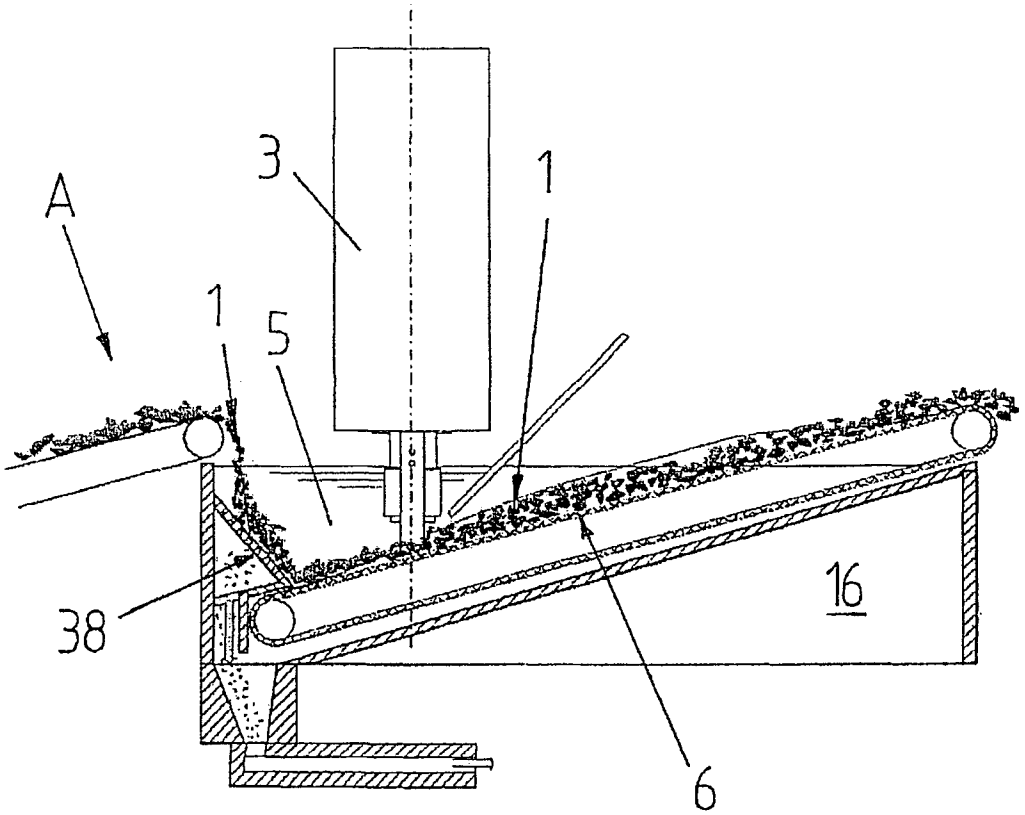
Figure 19:
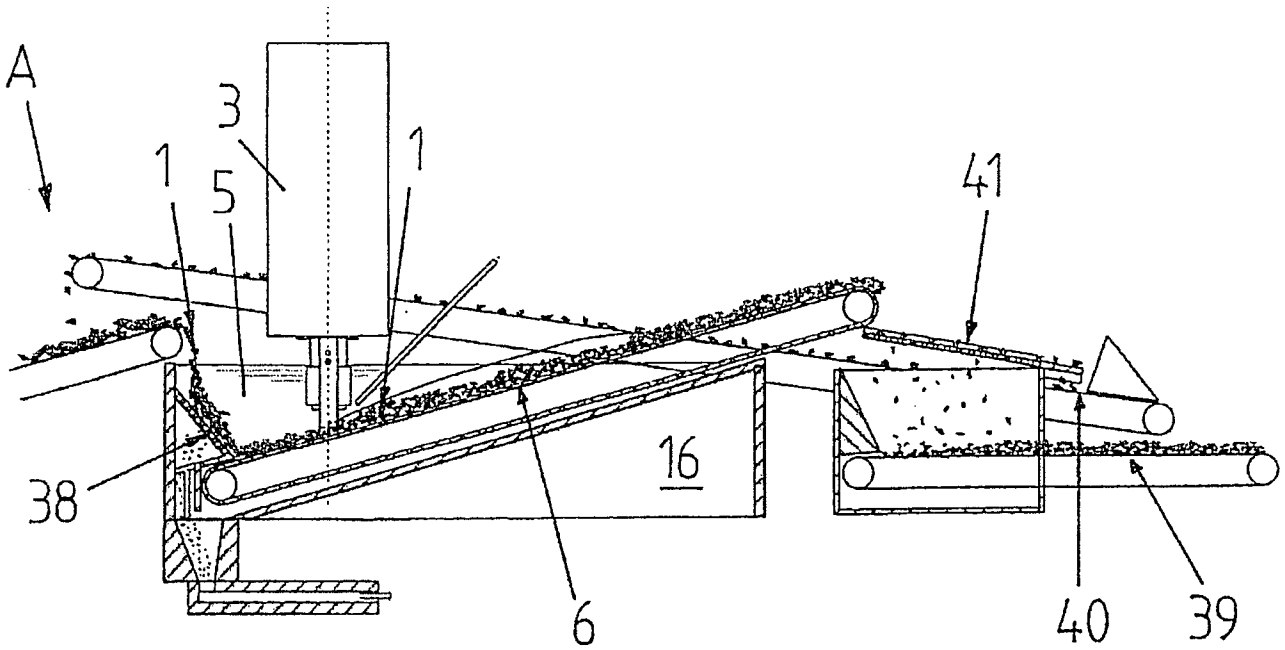

the FIGS. 16*a* and 16*b* cross-sections through the apparatus along the line H-H in FIG. 14;

the FIGS. 17 to 19 longitudinal sections as FIG. 14 through different variants of individual devices of the apparatus of FIG. 14.

DETAILED DESCRIPTION

Figure 1:
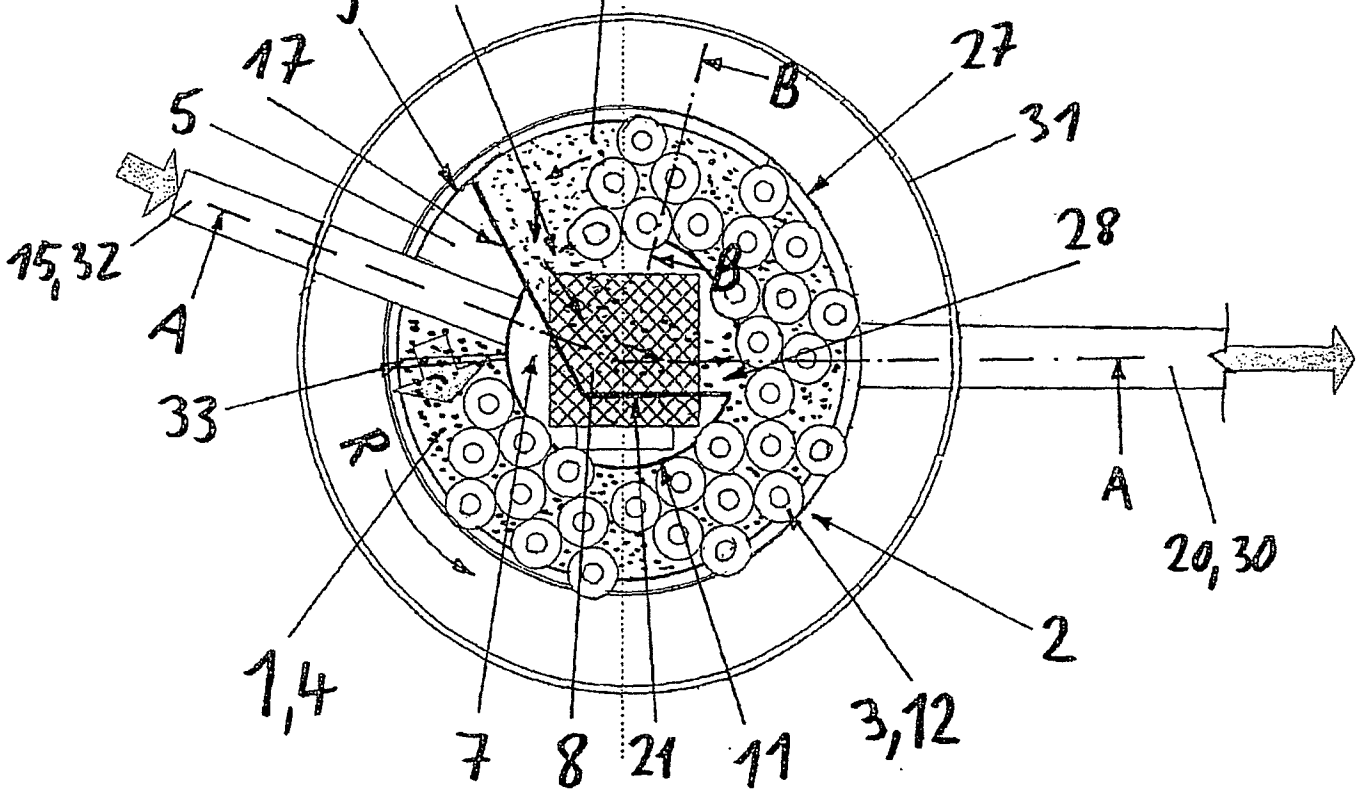
FIG. 1 a plan view on a first device according to the invention in a first operating mode.
Figure 2:
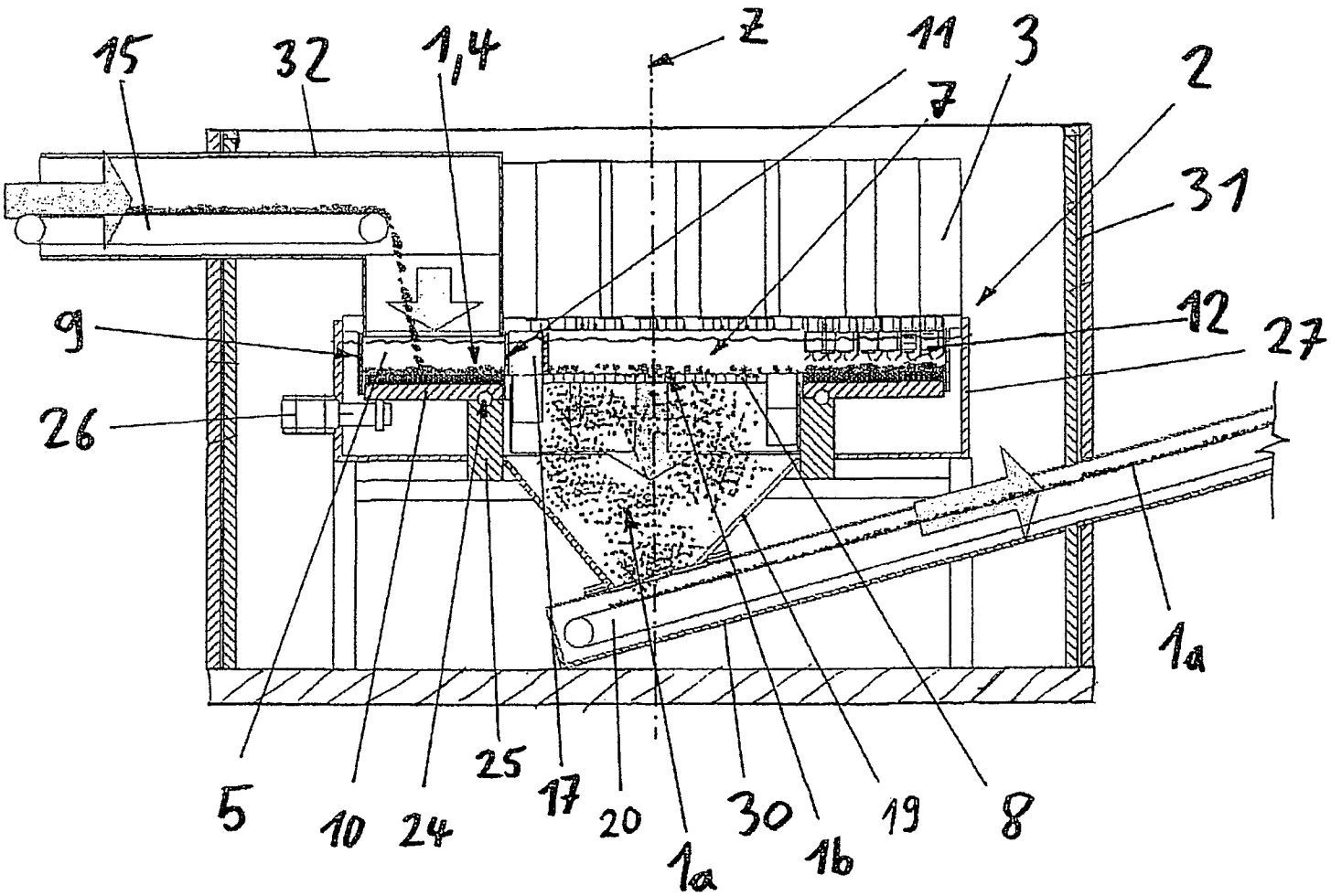
FIG. 2 a vertical section through the first device along the line A-A in FIG. 1.
Figure 3:
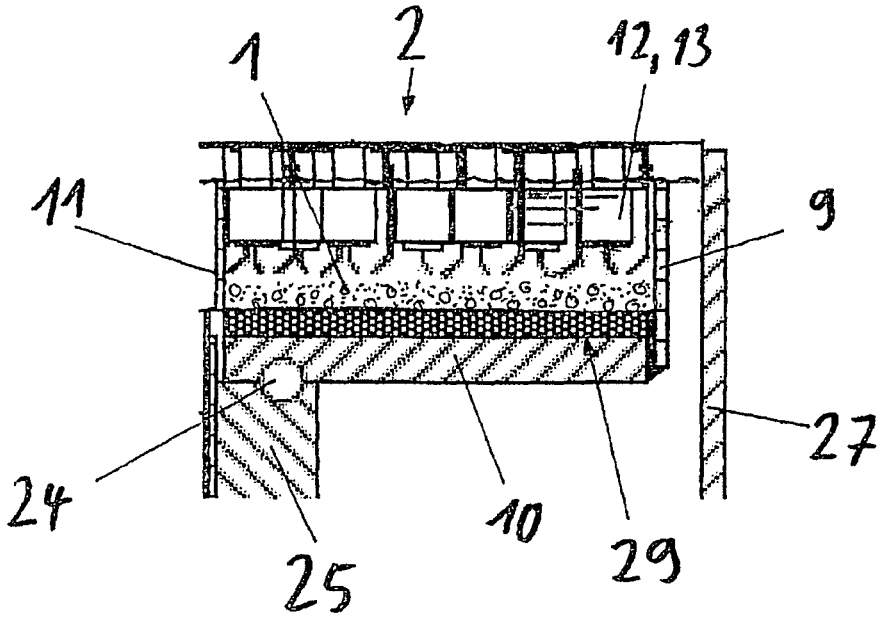
FIG. 3 a vertical section through the first device along the line B-B in FIG. 1.

The FIGS. 1 to 3 show a first device according to the invention for the fragmenting of pourable material 1 by means of high-voltage punctures, once in a plan view from above (FIG. 1), once in a vertical section along the line A-A in FIG. 1 (FIG. 2) and once in a partially vertical section along the line B-B in FIG. 1 (FIG. 3).

As can be seen, the device comprises a carousel-like device 9, 10, 11 formed by an annular base plate 10, a cylindrical outer wall 9 fixedly connected to the base plate 10 and projecting vertically upwards from the base plate 10, and a cylindrical inner wall 11 not being connected to the base plate 10 and projecting vertically upwards from the base plate 10. The base plate 10 is planar and continuously closed and is supported by means of a roller-collar 24 on an annular supporting element 25 of a fixed supporting structure, and is in the intended operation rotated around a vertical rotation axis Z going through the center of the annular shape of the base plate 10 in the direction of rotation R by a drive motor 26, by means of which the to-be-fragmented material 1 on the base plate 10 forms an annular or annular-segmented material flow 4 around the rotation axis Z in the direction of rotation R.

The carousel-like device 9, 10, 11 is arranged in a circular basin 27 filled with water 5 (process liquid), the bottom of which is penetrated by the annular supporting element 25. The carrousel-like device 9, 10, 11 is completely immersed in the water 5 in the basin 27, except for the upper delimiting edges of the outer wall 9 and of the inner wall 11. In the region within the annular supporting element 25, the bottom of the basin 27 is formed by a circular, downwardly extending funnel 19, the lower end of which ends over a conveying belt 20, which conveys slopingly upwards up to a level above the water level of the basin 27 (not completely shown here for reasons of space) and is arranged in a housing 30 which is connected to the lower funnel end and forms a watertight container together with the basin 27. The basin 27 is surrounded by an annular protective wall 31, through which the housing of the conveyor belt 30 and the conveyor belt 20 penetrate.

As can further be seen, the device comprises, arranged above the carrousel-like device 9, 10, 11, an electrode assembly 2 with a plurality of high-voltage Electrodes 12 arranged in a matrix-shape, which extends approximately over a range of 270° of the annular shape of the carrousel-like device 9, 10, 11. In the illustrated situation, each one of the high-voltage electrodes 12 thereby extends from above down to just above the surface of the annular-segmented material flow 4 guided in the carrousel-like device 9, 10, 11, wherein it immerges into the water 5, and comprises an own high-voltage generator 3 arranged directly above it, with which it is charged with high-voltage pulses during operation. For the sake of clarity, in the figures, only one of the high-voltage electrodes is provided with the reference numeral 12, each, and only one of the high-voltage generators is provided with the reference numeral 3, each.

Figure 5:
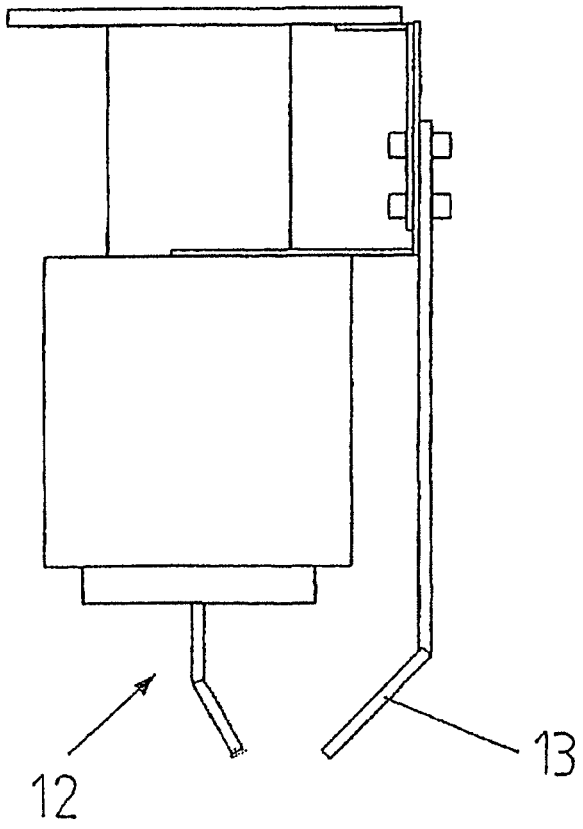
FIG. 5 a side view of one of the electrodes of the electrode assembly of the device from FIG. 1.

As can be seen from FIG. 5, which shows one of the high-voltage electrodes 12 of the electrode assembly 2 of this device in the side view, each of the high-voltage electrodes 12 comprises a respective counter-electrode 13 lying on earth potential. The high-voltage electrodes 12 and the counter-electrodes 13 assigned to these each face each other with a spacing transversely to the material guiding past direction and are thereby each arranged in such a way that, in the illustrated intended operation, high-voltage punctures between the high-voltage electrode 12 and the counter-electrode 13 assigned to it through the material 1 of the material flow 4 are produced by means of the charging of the respective high-voltage electrode 12 with high-voltage pulses. The high-voltage electrode 12 together with the single counter-electrode 13 assigned to it, thus forms an electrode pair 12, 13 according to the claims.

Figure 6:
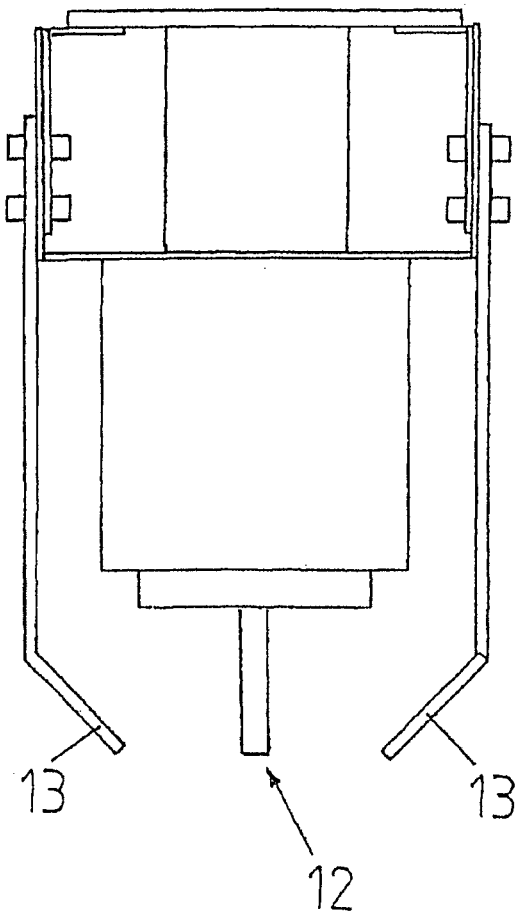
FIG. 6 a side view of a first variant of the high-voltage electrode from FIG. 5.
Figure 7:
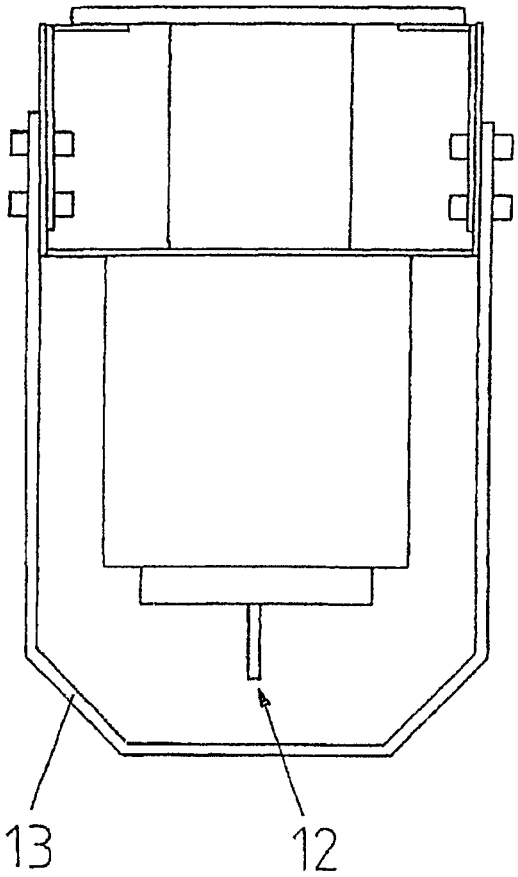
FIG. 7 a side view of a second variant of the high-voltage electrode from FIG. 5.

The FIGS. 6 and 7 show side views of two variants of the high-voltage electrode from FIG. 5.

FIG. 6 shows a high-voltage electrode 12 which differs from the one shown in FIG. 5 essentially in that it comprises two identical mirror-inverted facing counter-electrodes 13 and inclined towards the high-voltage electrode 12 at their free ends. The high-voltage electrode 12 together with the two counter-electrodes 13 thus forms an electrode group 12, 13 according to the claims. A further difference is that this high-voltage electrode 12 has a straight electrode tip.

FIG. 7 shows a high-voltage electrode 12 which differs from the one shown in FIG. 6 essentially in that here the two mirror-inverted facing counter-electrodes 13 shown in FIG. 6 are connected to a single, U-shaped counter-electrode 13 below the high-voltage electrode 12.

Depending on the process or the to-be-processed material, respectively, it is also foreseen that the electrodes 12 and the counter-electrodes 13 are immersed in the material flow.

As can further be seen, the device comprises a supply conveyor belt 15 arranged in a closed housing 32, with which to-be-fragmented material 1, in the present case fractures of noble metal ore rock 1, is provided to the base plate 10 of the carrousel-like device 9, 10, 11 upstream of the electrode assembly 2.

The height of the material filling 1 guided below the electrode assembly 2 as annular-segmented material flow 4 is limited before the inlet into the region formed between the carrousel-like device 9, 10, 11 and the electrode assembly 2 (process zone) by a passage-limiting plate 33.

Downstream of the electrode assembly 2, there is a fixed first guiding plate 17, which extends from the outer wall 9 of the carousel-like device 9, 10, 11 through a first gap 23 in its inner wall 11 into a region 7 in the center of the carrousel-like device 9, 10, 11 and, in the illustrated intended operation, essentially completely guides material flow 4 emerging from the process zone into the central region 7 via the first gap 23 in the inner wall 11.

The bottom of the central region 7 is designed as a planar sieve bottom 8 with a sieve opening size which is dimensioned such that material 1*a* fragmented to the target size passes through the sieve openings and falls into the below arranged funnel 19, while material 1*b* which is larger than the target size, remains on the sieve bottom 8. The completely processed or fragmented to target size material 1*a*, respectively, is guided by the funnel 19 onto the conveyor belt 20, with which it is transported out of the device.

The incompletely processed or not yet fragmented to target size material 1*b*, respectively, is pushed over the sieve bottom 8 by the succeeding material 1 and is, by a fixed second guiding plate 21 adjoining the first guiding plate 17, via a second gap 28 in the inner wall 11 fed from the central region 7 back into the annular-segmented material flow 4, with which it is again guided past a part of the high-voltage electrodes 12 of the electrode assembly 2 and thereby charged with high-voltage punctures.

As can be seen from FIG. 3, which shows a vertical section through a part of the first device in the region of the process zone along the line B-B in FIG. 1, the base plate 10 of the carrousel-like device 9, 10, 11 comprises a top side covered with a wear-inhibiting layer 29 of rubber, on which the to-be-processed material 1 rests.

Figure 4:
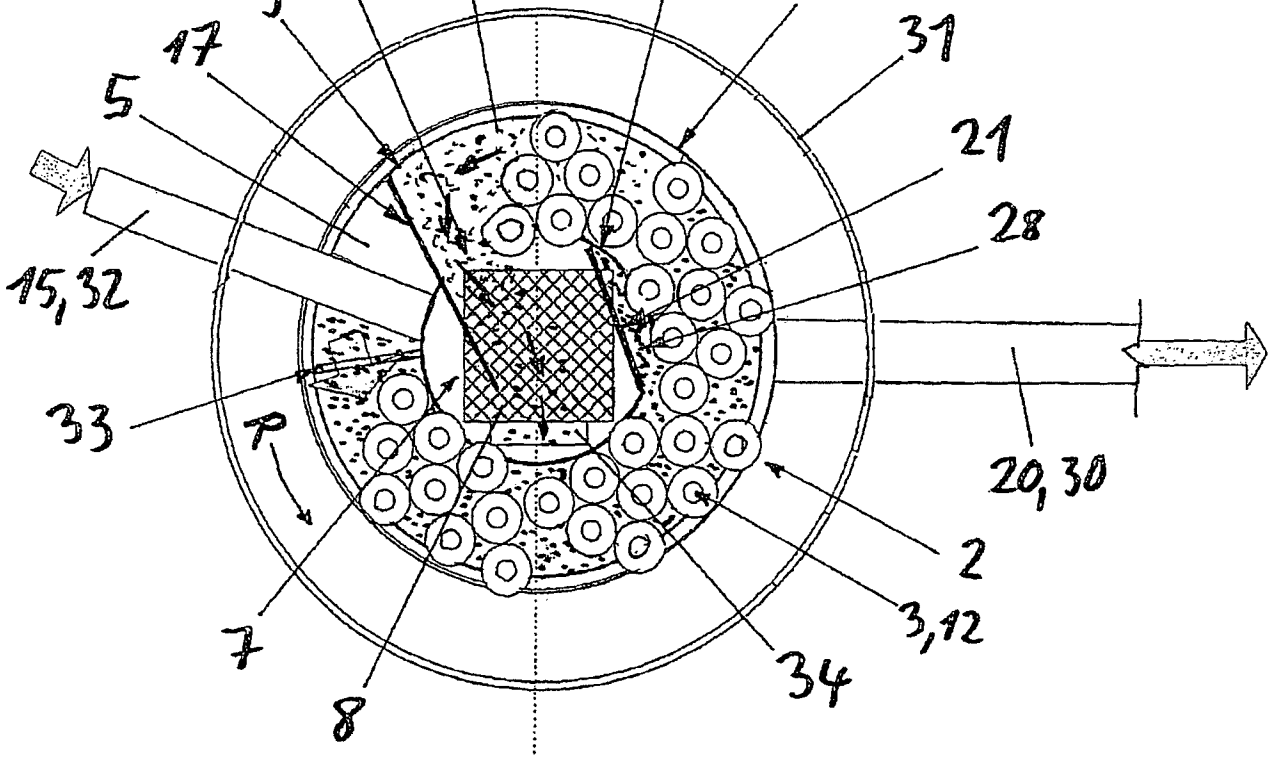
FIG. 4 a plan view on the first device in a second operating mode.

FIG. 4 shows a plan view on the device in a different operating mode. As can be seen, here, the second guiding plate 21 is arranged in a position in which it closes the second gap 28 in the inner wall 11 from the side of the central region 7 and opens up a discharge duct 34 into which the incompletely processed or not yet fragmented to target size material 1*b*, respectively, which is pushed over the sieve bottom 8 by the succeeding material 1, falls into and is then guided away from the device by (not shown) devices.

Figure 8:
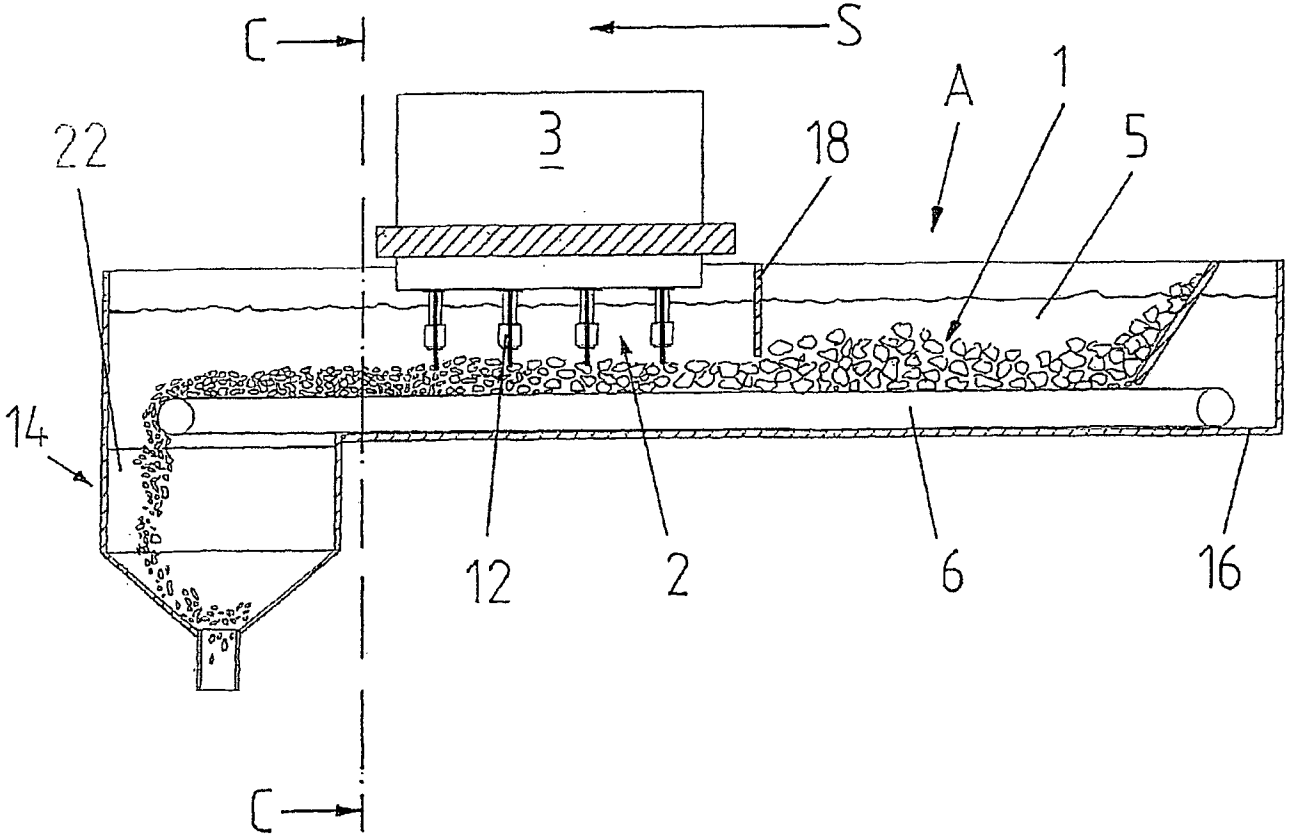
FIG. 8 a longitudinal section along the line D-D in FIG. 10 through a second device according to the invention.
Figure 9:
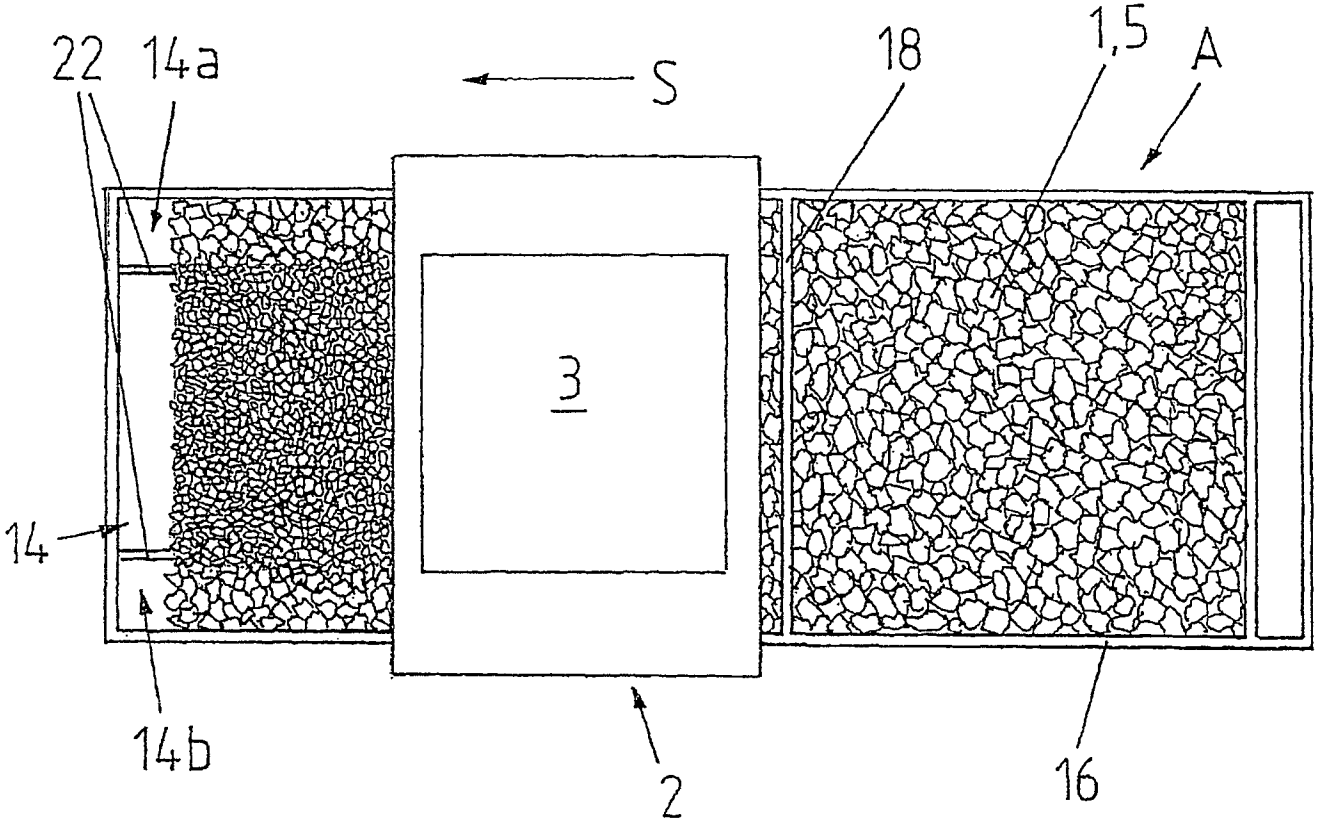
FIG. 9 a plan view from above on the device from FIG. 8.
Figure 10:
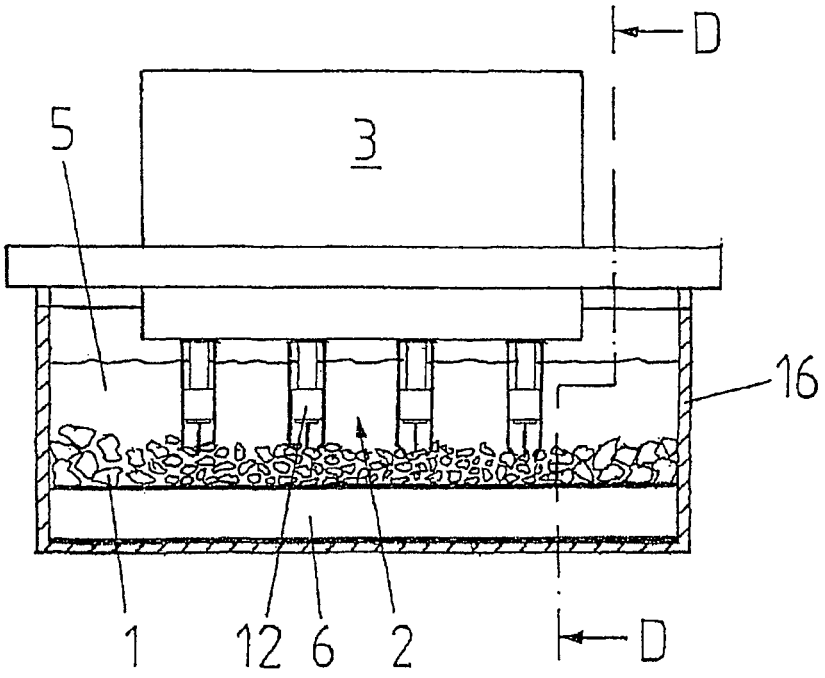
FIG. 10 a cross-section through the device along the line C-C in FIG. 8.

The FIGS. 8 to 10 show a second device according to the invention for fragmenting of pourable material 1 by means of high-voltage discharges, once in a longitudinal section along the line D-D in FIG. 10 (FIG. 8), once in a plan view from above (FIG. 9), and once in a cross-section along the line C-C in FIG. 8 (FIG. 10).

As can be seen, the device comprises an electrode assembly 2 with a matrix of high-voltage electrodes 12, which, as viewed in material flow direction S, are arranged in four successively arranged rows, each with four high-voltage electrodes 7 (only one of the electrodes is provided with the reference numeral 12 in the figures for the sake of clarity).

In the illustrated intended operation, the electrodes 12 are each charged with high-voltage pulses by a high-voltage generator 3 arranged directly above them.

Below the electrode assembly 2, a conveyor belt 6 is arranged in a basin 16 flooded with water 5 (process liquid), with which a material flow of a to-be-fragmented, pourable material, in the present case fragments of ore rock, is guided past the electrodes 12 of the electrode assembly 2 from the feed side A of the device in the material flow direction S, while high-voltage punctures through the material 1 are produced as a result of a charging of the electrode assembly 2 with high-voltage pulses. Thereby, the material 1 of the material flow is immersed in the water 5 located in the basin 16, as well as the electrodes 12 arranged thereabove.

The height of the material flow is adjusted before the inlet into the region between the conveyor belt 6 and the electrode assembly 2 (process zone) by means of a passage limiting plate 18.

As can be seen from FIG. 10, the conveyor belt 6, as viewed in the flow direction S, extends over the entire width of the basin 16 such that the moved material flow encompasses the entire width of the basin 16.

As can be seen in particular from the FIGS. 8 and 10, the central zone of the material flow is charged with high-voltage punctures during passing through of the process zone, which results in an increasing fragmenting of the material 1 in this region, while the boundary zones of the material flow remain practically unaffected by high-voltage punctures, such that the material 1 guided therein retains its original piece size.

Downstream of the electrode assembly 2, the material flow emerging from the process zone is discharged from the conveyor belt 6 into three collecting funnels 14, 14*a*, 14*b* separated by separation walls 22 and extending side by side next to each other over the entire width of the conveyor belt 6 at the end of the basin 16. Thereby, the separation walls 22 are arranged in such a way that the fragmented material 1 from the central zone of the material flow is discharged into the central collecting funnel 14, while the non-fragmented material 1 from the boundary zones of the material flow is discharged into the outer collection funnels 14*a*, 14*b*.

The fragmented material 1, which is discharged into the central collection funnel 14, is conveyed out of the basin 16 by means of a (not shown) conveying device and fed to another use. The non-fragmented material 1, which is discharged into the outer collecting funnels 14*a*, 14*b*, is conveyed out of the basin 16 by means of (not shown) conveying devices and fed back into the material flow on the feed side A of the device.

As can be seen from FIG. 6, which shows one of the electrodes 12 of the electrode assembly 2 of the device in the side view, each of the high-voltage electrodes 12 comprises two identical mirror-inverted facing counter-electrode each inclined towards the high-voltage electrode 12 at their free ends, which lie on ground potential and are attached to the supporting structure of the high-voltage electrode 12. The high-voltage electrode 12 together with the two counter-electrodes 13 forms an electrode group 12, 13 according to the claims. Thereby, the high-voltage electrodes 12 and the respective two counter-electrodes 13 assigned to these, face each other with an electrode spacing transversely to the material guiding past direction and are immersed in the material flow.

Figure 11:
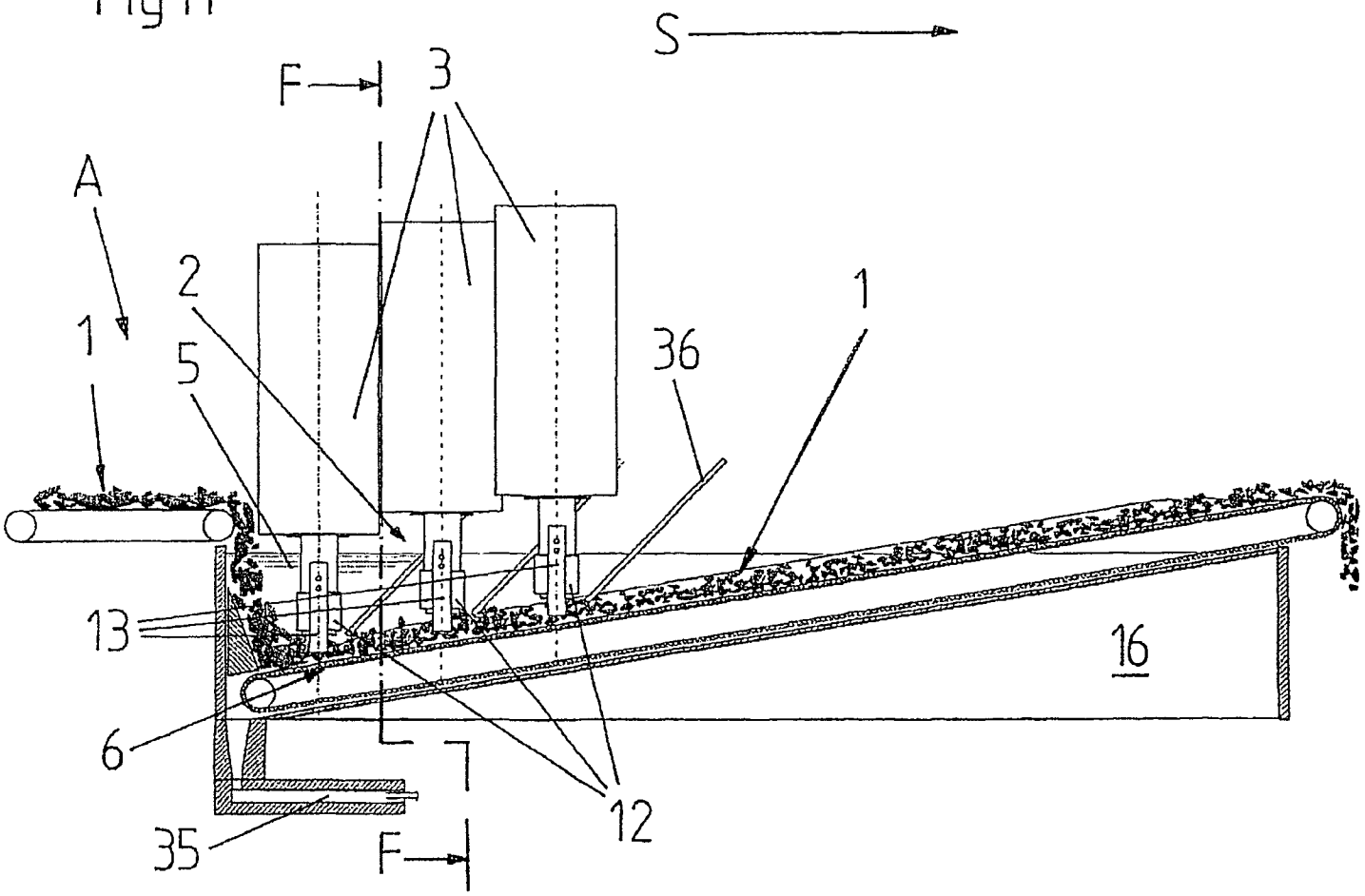
FIG. 11 a longitudinal section along the line E-E in FIG. 13 through a third device according to the invention.
Figure 12:
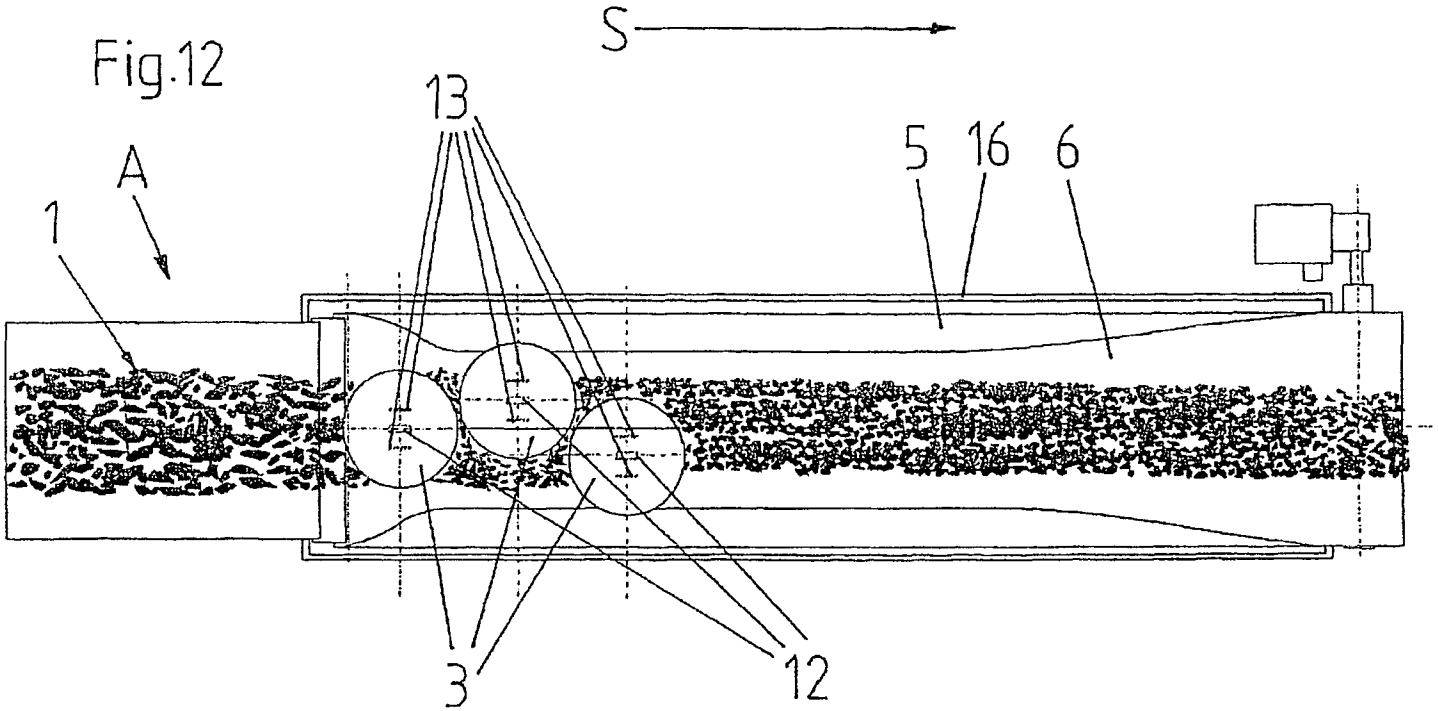
FIG. 12 a plan view from above on the device from FIG. 11.
Figure 13:
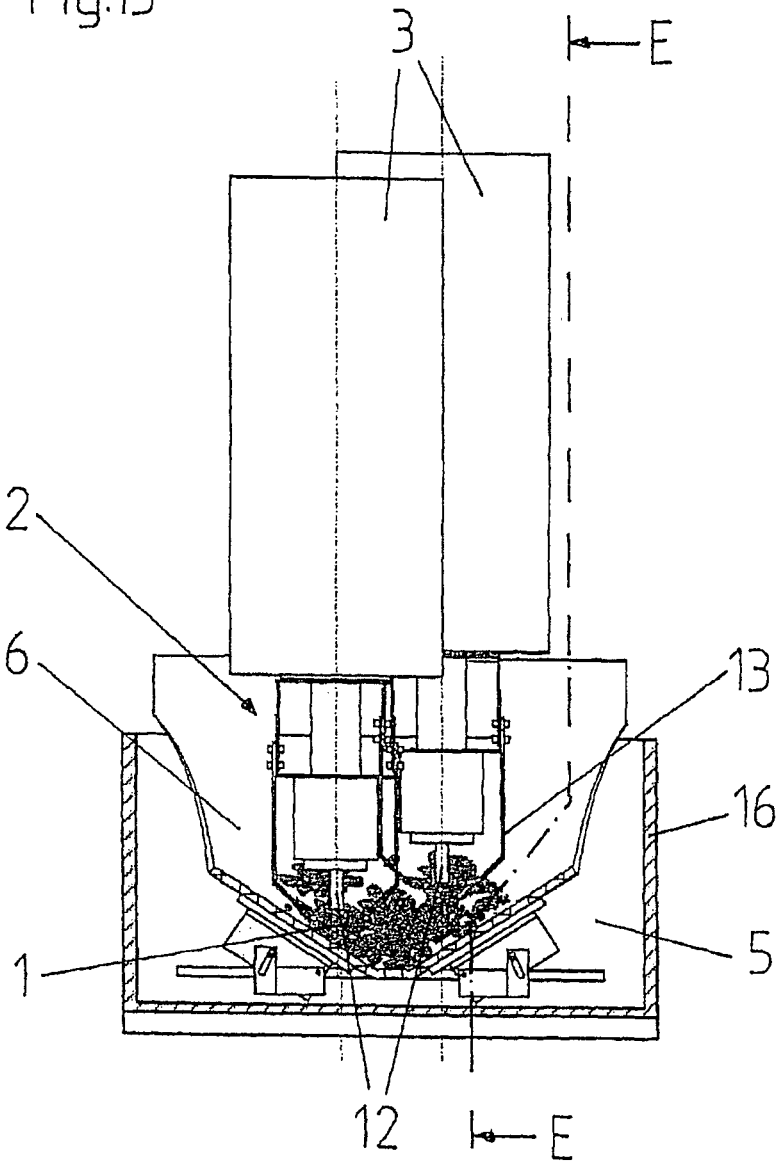
FIG. 13 a cross-section through the device along the line F-F in FIG. 11.

The FIGS. 11 to 13 show a third device according to the invention for fragmenting of pourable material 1 by means of high-voltage discharges, once in a longitudinal section along the line E-E in FIG. 13 (FIG. 11), once in a plan view from above (FIG. 12) and once in a cross-section along the line F-F in FIG. 11 (FIG. 13).

As can be seen, the device comprises an electrode assembly 2 with three high-voltage electrodes 12, which are arranged one behind the other in material flow direction S.

Also here, the high-voltage electrodes 12 and the assigned counter-electrodes 13 are structured as shown in FIG. 6, face each other with an electrode spacing transversely to the material guiding past direction and are immersed in the material flow.

As can further be seen from FIG. 12, in which the positions of the respective high-voltage electrodes 12 and counter-electrodes 13 are shown dashed, these electrode groups 12, 13 each have a lateral offset with respect to each other in the material flow direction S.

In the illustrated intended operation, the high-voltage electrodes 12 are each charged with high-voltage pulses by a high-voltage generator 3 arranged directly above them.

Below the electrode assembly 2, there is, arranged in a basin 16 flooded with water 5 (process liquid), a straight conveyor belt 6 rising in a material flow direction S with an angle of 10 degrees made of a flexible, electrically non-conductive strip material (fabric-reinforced rubber), by means of which a material flow of the to-be-fragmented pourable material 1, in the present case slag pieces from waste incineration with a maximum piece size of 80 mm, is guided past the electrodes 12, 13 of the electrode assembly 2 from the feed side A of the device in the material flow direction S, while high-voltage punctures through the material 1 as a result of a charging of the high-voltage electrodes 12 of the electrode assembly 2 with high-voltage pulses are produced. Thereby, the material 1 of the material flow is immersed in the water 5 located in the basin 16 in the region of the electrode assembly 2, as are the electrodes 12, 13 arranged thereabove, which are also immersed in the material flow.

At the same time, process water is discharged from the basin 16 via a discharge line 35 arranged at the bottom of the basin 16 and supplied to a (not shown) water treatment plant, from which treated process water is conveyed back into the basin 16 via supply lines 36, which each inject the water into the material flow in the region of the electrodes 12, 13.

As can be seen from the FIGS. 12 and 13, the boundary zones of the conveyor belt 6 are arched upwards in the region in which it guides the material flow past the electrode assembly 2, such that the conveyor belt 6 is formed in this region as viewed in the cross-section trough-shaped or V-shaped, respectively, in such a way that the pourable material 1 of the material flow is guided from the lateral zones into the center.

By means of this, the material flow is charged with high-voltage punctures essentially over its entire width, which leads to a fragmenting of the entire material flow.

The inclination angle of the boundary zones of the conveyor belt is adjustable in order to be able to optimally adapt the device to the to-be-processed material or its piece size, respectively. The conveyor belt 6 is planar in the region of its ends.

Downstream from the electrode assembly 2, the material flow emerging from the process zone is discharged out of the basin 16 upwards by the conveyor belt 6 and afterwards fed to a further (not shown) utilization or processing step, respectively.

The FIGS. 14, 15, 16*a* and 16*b* show an apparatus according to the invention for fragmenting of pourable material 1 by means of high-voltage discharges, once in a longitudinal section along the line G-G in FIG. 16*a* (FIG. 14), once in a plan view from above (FIG. 15) and twice in a cross-section along the line H-H in FIG. 14 (FIGS. 16*a* and 16*b*).

As can be seen, this apparatus consists of three devices according to the FIGS. 11 to 13 connected in series (three steps), with the difference that each of the devices instead of the three electrode groups 13, 12, 13 arranged one behind the other in the material flow direction S and offset with respect each other and with its own high-voltage generator 3 each, has only one centrally positioned electrode group 13, 12, 13, each, with respectively assigned high-voltage generator 3. In addition, the ascent angle of the conveyor belt 6 is with 15 degrees here considerably steeper than in the previously described third device according to the invention according to the FIGS. 11 to 13. All other details are carried out identically and are therefore not explained here again.

The FIGS. 16*a* and 16*b* show cross-sections through the apparatus along the line H-H in FIG. 14 (although without basin and high-voltage generator) at different settings of the inclination angles $\alpha$ of the boundary zones of the illustrated conveyor belt 6, namely once at inclination angles $\alpha$ of 23 degrees (FIG. 16*a*) and once at inclination angles $\alpha$ of 33 degrees (FIG. 16*b*).

The FIGS. 17 to 19 show longitudinal sections as FIG. 14 through different variants of a device of the apparatus according to the FIGS. 14, 15, 16*a*, and 16*b*.

The first device variant according to FIG. 17 differs from the device shown in FIG. 14 in that the to-be-processed material is fed to the feeding end A of the device via an inclined sieving surface 37 arranged outside of the basin 16, by means of which fine material with a specific piece size, e.g., depending on the arrangement location of the device within the apparatus of smaller than 2 mm, smaller than 5 mm, or smaller than 8 mm, is sieved even before the entry into this device.

The second device variant according to FIG. 18 differs from the device shown in FIG. 14 in that the to-be-processed material at the feeding end A of the device is fed onto the conveyor belt 6 of the device via an inclined sieving surface 38 arranged within the basin 16, by means of which fine material with a specific piece size, e.g., depending on the arrangement location of the device within the apparatus of smaller than 2 mm, smaller than 5 mm, or smaller than 8 mm, is sieved within the basin 16 of this device but before the entry into the process zone.

The third device variant according to FIG. 19 consists of a device according to FIG. 18, at the discharge end of which the processed material is discharged onto an inclined sieving surface 41 through which the material fragmented to a desired piece size falls onto a below arranged further transporting conveyor belt 39. The insufficiently fragmented material travels over the sieving surface 38 and at its end falls onto a conveyor belt 40 with which it is conveyed back to the feeding end of the device and is fed back again into the to-be-processed material flow 1.

The devices according to the FIGS. 17 to 19 each individually also form a device according to the invention.

While there are described preferred embodiments of the invention in the present application, it is to be clearly pointed out that the invention is not limited thereto and can also be carried out in another manner within the scope of the following claims.

The invention claimed is:

1. A method for fragmenting pourable solid material by high-voltage discharges, comprising the steps:

a) providing an electrode assembly which is assigned to one or more high-voltage generators, by which the electrode assembly is chargeable with high-voltage pulses;

b) guiding a material flow of pourable solid material past the electrode assembly with a conveying device carrying the material flow of pourable solid material, wherein the material flow of pourable solid material is immersed in a process liquid; and c) producing high-voltage punctures through the material flow to fracture and crush the solid material while guiding the solid material past the electrode assembly by charging of the electrode assembly with high-voltage pulses, wherein electrodes of the electrode assembly are submerged from above in the process liquid, and face each other with an electrode spacing transverse to a direction in which the material flow is guided.

2. The method according to claim 1, wherein the electrodes of the electrode assembly are in contact with the material flow.

3. The method according to claim 2, wherein the electrodes of the electrode assembly are immersed in the material flow.

4. The method according to claim 1, wherein the material flow is formed by material pieces which do not exceed a maximum piece size in the range between 40 mm and 80 mm, and wherein the electrode spacing is larger than the maximum piece size.

5. The method according to claim 1, wherein the high-voltage punctures are produced in such a way that the material flow is charged with high-voltage punctures over an entire width of the material flow.

6. The method according to claim 1, wherein the pourable material of the material flow or a part thereof is divided into coarse material having a piece size larger than a desired target size and into fine material having a piece size smaller than or equal to the desired target size downstream of the electrode assembly.

7. The method according to claim 6, wherein the coarse material is fed again into the material flow upstream of the electrode assembly.

8. The method according to claim 6, wherein the coarse material is subjected to a further fragmenting or weakening method.

9. The method according to claim 1, wherein the material flow is formed by material pieces or comprises material pieces which do not exceed a maximum piece size in the range between 40 mm and 80 mm, and wherein the distance of the electrodes to a bottom side of the material flow is larger than this maximum piece size.

10. The method according to claim 1, wherein the conveying device, at least in a region in which the conveying device guides the material flow past the electrode assembly, has a trough-shaped cross-section such that that the pourable material is guided from lateral zones into a center.

11. The method according to claim 1, wherein the material flow is guided past the electrode assembly by a flexible, electrically nonconductive conveyor belt, wherein boundary zones of the conveyor belt are arched upwards in a region in which the conveyor belt guides the material flow past the electrode assembly, and wherein the conveyor belt is planar in a region of ends of the conveyor belt.

12. The method according to claim 11 wherein inclinations of the boundary zones of the conveyor belt are adjusted.

13. The method according to claim 1, wherein the material flow, downstream from a region in which the material flow is guided past the electrode assembly with the conveying device or the conveyor belt, respectively, is transported upwards with the conveying device or the conveyor belt, respectively, in such a way that the material flow is guided out of the process liquid with the conveying device or with the conveyor belt, respectively.

14. The method according to claim 13, wherein a straight conveyor belt is used, with an ascent angle in the material flow direction of between 10 and 35 degrees.

15. The method according to claim 13, wherein the material flow transported upwards with the conveyor belt from a delivery end of the conveyor belt, via a device for sieving of material pieces fragmented to a specific target size, is fed to a below arranged feeding end of another conveyor belt.

16. The method according to claim 1, wherein the electrode assembly comprises a plurality of electrode pairs or electrode groups, wherein a respective high-voltage generator is assigned to each electrode pair or each electrode group, with which exclusively a respective pair or a respective group is charged with high-voltage pulses independently of the other electrode pairs or electrode groups.

17. The method according to claim 1, wherein the material flow is formed by material pieces or comprises material pieces which form a composite of metallic and non-metallic materials.

18. The method according to claim 17, wherein the process liquid has a conductivity of more than 500 μS/cm.

19. The method according to claim 17, wherein the processed material resulting from the method is divided into metallic material and non-metallic material.

20. The method according to claim 1, wherein the electrode assembly for producing the high-voltage punctures through the material flow is charged with high-voltage pulses in the range between 100 kV and 300 kV.

21. The method according to claim 1, wherein the electrode assembly for producing the high-voltage punctures through the material flow is charged with high-voltage pulses with a power per pulse of between 100 Joule and 1000 Joule.

22. The method according to claim 1, wherein the electrode assembly for producing the high-voltage punctures through the material flow is charged with high-voltage pulse frequencies in the range between 0.5 Hz and 40 Hz.

23. The method according to claim 1, wherein the material flow when guided past the electrode assembly is charged with 0.1 to 2.0 high-voltage punctures per millimeter of length in the material flow direction.

24. A device for fragmenting pourable solid material by high-voltage discharges, the device comprising:

a) an electrode assembly which is assigned to one or more high-voltage generators, by which the electrode assembly is chargeable with high-voltage pulses;

b) a conveying device at least in part arranged in a basin which is filled with a process liquid, the conveying device configured to guide a material flow of a pourable solid material immersed in the process liquid past the electrode assembly, wherein electrodes of the electrode assembly are immersed in the process liquid from above and face each other with an electrode spacing transverse to a direction in which the conveyor guides the material flow, the electrode assembly configured to produce high-voltage punctures through the material flow to fracture and crush the solid material by charging the electrode assembly with high-voltage pulses as the conveyor guides the material flow past the electrode assembly.

25. The device according to claim 24, wherein the electrodes of the electrode assembly are positioned to be in contact with the material flow during operation of the device.

26. The device according to claim 25, wherein the electrodes of the electrode assembly are positioned to be immersed in the material flow with a distance to a bottom side of the material flow of more than 40 mm during operation of the device.

27. The device according to claim 24, wherein the electrode spacing is greater than 40 mm.

28. The device according to claim 24, wherein the electrode assembly is arranged to charge the material flow with high-voltage punctures over an entire width of the material flow.

29. The device according to claim 24, comprising, downstream from the electrode assembly, devices with which the material of the material flow or a part thereof can be divided into coarse material with a piece size larger than a desired target size and into fine material with a piece size smaller than or equal to the desired target size.

30. The device according to claim 24, wherein the electrode assembly comprises a plurality of electrode pairs or electrode groups, and wherein a respective high-voltage generator is assigned to each electrode pair or each electrode group for exclusively charging a respective electrode pair or a respective electrode group with high-voltage pulses.

31. The device according to claim 24, wherein the conveying device, at least in a region in which the conveying device guides the material flow past the electrode assembly, has a trough-shaped cross-section such that the pourable material is guided from lateral zones into a center.

32. The device according to claim 31, wherein the conveying device comprises a flexible, electrically nonconductive conveyor belt, with which material flow is guided past the electrode assembly, wherein boundary zones of the conveyor belt are arched upwards in a region in which the conveyor belt guides the material flow past the electrode assembly, and wherein the conveyor belt is planar in a region of ends of the conveyor belt.

33. The device according to claim 32, wherein inclinations of the boundary zones of the conveyor belt are adjustable.

34. The device according to claim 24, wherein the conveying device comprises a conveyor belt configured to transport the material flow upwards out of the process liquid, downstream of a region in which the material flow is guided past the electrode assembly with the conveyor belt.

35. The device according to claim 34, wherein the conveyor belt is a straight conveyor belt with an ascent angle in the material flow direction of between 15 and 35 degrees.

36. The device according to claim 24, wherein the conveying device includes a conveyor belt or a conveyor chain.

* * * * *